US012157596B2

(12) United States Patent
Mariani et al.

(10) Patent No.: US 12,157,596 B2
(45) Date of Patent: Dec. 3, 2024

(54) BOTTLE CAPPING STATION, IN PARTICULAR FOR PRODUCTS OF THE PHARMACEUTICAL INDUSTRY

(71) Applicant: G.D SOCIETA' PER AZIONI, Bologna (IT)

(72) Inventors: Luca Mariani, Bologna (IT); Luca Testoni, Bologna (IT); Andrea Dondini, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 339 days.

(21) Appl. No.: 17/610,143

(22) PCT Filed: May 22, 2020

(86) PCT No.: PCT/IB2020/054891

§ 371 (c)(1),
(2) Date: Nov. 9, 2021

(87) PCT Pub. No.: WO2020/240380

PCT Pub. Date: Dec. 3, 2020

(65) Prior Publication Data

US 2022/0212820 A1 Jul. 7, 2022

(30) Foreign Application Priority Data

May 24, 2019 (IT) ..... 102019000007195

(51) Int. Cl.
*B65B 7/28* (2006.01)
*B65B 51/14* (2006.01)
*B65B 57/00* (2006.01)

(52) U.S. Cl.
CPC ..... *B65B 7/2878* (2013.01); *B65B 51/142* (2013.01); *B65B 57/00* (2013.01)

(58) Field of Classification Search
CPC ..... B65B 7/2878; B65B 57/00; B65B 51/142
See application file for complete search history.

(56) References Cited

U.S. PATENT DOCUMENTS 3,491,510 A * 1/1970 Sternau ..... B29C 66/24244 53/329.2
3,610,299 A * 10/1971 Jureit ..... B23D 59/008 700/192

(Continued)

FOREIGN PATENT DOCUMENTS

CN 103781704 A 5/2014
EP 1262445 A1 12/2002

(Continued)

OTHER PUBLICATIONS

International Search Report and Written Opinion for corresponding International Application No. PCT/IB2020/054891, mailing date Sep. 30, 2020.

(Continued)

*Primary Examiner* — Thomas M Wittenschlaeger
*Assistant Examiner* — David G Shutty
(74) *Attorney, Agent, or Firm* — MARSHALL, GERSTEIN & BORUN LLP

(57) ABSTRACT

A capping station has a first conveying system designed to move a plurality of full bottles; a second conveying system, arranged above the first conveying system, designed to move a plurality of caps; a capping device designed to pick up at least one cap from the second conveying system in order to apply the cap to a bottle carried by the first conveying system; and a heating unit comprising at least one heating device, a support beam carrying the heating device, a main operating device designed to move the support beam between a rest position in which the heating device is far from the bottles and a work position in which the heating device is close to the bottles to heat at least the neck of the (Continued)

bottles, and a safety operating device independent of the main operating device, designed to move the support beam between the work and rest positions.

12 Claims, 6 Drawing Sheets

(56) References Cited

U.S. PATENT DOCUMENTS 3,706,176 A * 12/1972 Leatherman ..... B65B 51/227 53/329.2
3,755,987 A * 9/1973 Dardaine ..... B29C 66/112 53/367
3,815,314 A * 6/1974 Pollock ..... B65B 51/227 53/471
4,095,390 A * 6/1978 Knudsen ..... B65B 51/18 53/316
4,237,360 A * 12/1980 Pohlenz ..... B29C 66/53421 219/652
4,238,267 A * 12/1980 Konstantin ..... B29C 66/542 156/499
4,682,463 A * 7/1987 Foldesi ..... B65B 7/2878 53/308
5,241,801 A * 9/1993 Nelson ..... B65B 7/2807 53/329.2
5,308,233 A * 5/1994 Denis ..... B29C 49/6445 425/525
5,321,934 A * 6/1994 Bech ..... B67B 3/2053 53/329.2
5,444,963 A * 8/1995 Steingroever ..... B67B 3/10 53/DIG. 2
6,412,252 B1 * 7/2002 Sarles ..... B29C 66/836 53/329.2
6,684,603 B2 * 2/2004 Nervo ..... B67B 1/03 53/167
6,747,252 B2 * 6/2004 Herzog ..... B29C 65/3644 219/656
8,075,726 B2 * 12/2011 Nakaya ..... B29C 66/542 220/359.4
8,770,428 B2 * 7/2014 Brauer ..... B65B 7/2835 220/359.3
2003/0019364 A1 * 1/2003 Carvin ..... A47G 19/2205 99/275
2009/0145083 A1 * 6/2009 Dumargue ..... B67B 3/00 53/285
2022/0212820 A1 * 7/2022 Mariani ..... B65B 7/28

FOREIGN PATENT DOCUMENTS

EP 2492238 A1 8/2012
JP H5-170285 A 7/1993

OTHER PUBLICATIONS

Office Action, Japanese patent application No. 2021-569477, dated Janaury 26, 2024.

* cited by examiner

BOTTLE CAPPING STATION, IN PARTICULAR FOR PRODUCTS OF THE PHARMACEUTICAL INDUSTRY

CROSS-REFERENCE TO RELATED APPLICATIONS

This patent application is a U.S. national phase of International Patent Application No. PCT/IB2020/054891 filed May 22, 2020, which claims the benefit of priority from Italian patent application no. 102019000007195 filed on 24 May 2019, the respective disclosures of which are each incorporated herein by reference in their entireties.

TECHNICAL FIELD

The present invention relates to a capping station for a filling machine to fill bottles (i.e. bottles, small bottles, flasks or other containers).

The present invention finds advantageous application to a bottle filling machine for products of the pharmaceutical industry to which the following discussion will make explicit reference without thereby losing its generality.

PRIOR ART

A filling machine to fill bottles for products of the pharmaceutical industry comprises a conveying system which moves a succession of bottles through an empty bottle weighing station, through a filling station wherein a predetermined quantity of liquid or powdery product is fed into each bottle, through a full bottle weighing station, through a capping station, wherein each bottle is provided with a respective cap, and finally through a labeling station wherein at least one label is applied to each bottle.

In particular, a known capping station comprises a lower conveying system which moves a plurality of full bottles in an upright position, an upper conveying system, arranged above the lower conveying system, which moves a plurality of caps designed for closing each one a respective bottle, and a capping device which picks up a cap from the lower conveying system and applies it to a respective bottle (placing the cap on the neck of the bottle). For this latter operation, the capping station is provided with a heating unit designed for heating at least the neck (and possibly also the cap) so as to allow the sealing between the cap and neck of the bottle once they are brought into contact with one other. Such heating unit comprises a plurality of electrical resistances carried by a support beam which can be operated in movement by an electric motor between a work position, wherein the plurality of resistances is close to the bottles (and possibly also to the caps) so that the heat of the resistances affects at least the neck of each bottle, and a rest position, wherein the plurality of resistances are sufficiently far from the bottles so as to ensure that the heat affects neither the bottles nor the caps. In detail, a known heating unit comprises an operating device, generally electric, arranged for operating the support beam forward up to the work position, before the cap is applied, and for operating the heating device backwards up to the rest position after a predetermined time interval. The predetermined time interval will be such as to ensure that the heat of the electrical resistances affects the area between the neck of the bottle and the cap for a time sufficient to partially soften at least the neck of the bottle (and possibly also the cap), so as to allow the welding between the cap and neck once brought into contact with one other.

However, such system has some drawbacks: in fact if, due to any fault of the operating device, the support beam is not retracted to the rest position after the predetermined time interval, an excessive heating of the neck of the bottle (and possibly of the cap) occurs. This could cause an excessive softening of the neck of the bottle (and possibly of the cap) with the consequent risk of permanent deformation of the bottle and/or the cap, which could damage the capping and/or make the bottle unusable or, in the worst cases, the heating could be such as to cause the bottle and/or the cap to catch fire.

The patent application US2009145083A1 describes a bottle capping station provided with a capping head carried by a hollow support element in the form of a bracket, movable vertically and comprising a vertical part which passes through a cover; the operating mechanism of the rotation of the capping head and the control mechanism of the jaws of the capping head are contained in a part of the support element which extends above the cover.

DESCRIPTION OF THE INVENTION

The object of the present invention is to provide a bottle capping station, in particular for products of the pharmaceutical industry, which is provided with a heating unit, is free from the drawbacks described above and is, at the same time, easy and cost-effective to manufacture.

According to the present invention, a bottle capping station for products of the pharmaceutical industry is provided, according to what claimed in the appended claims. The claims describe embodiments of the present invention forming an integral part of the present description.

BRIEF DESCRIPTION OF THE DRAWINGS

The present invention will now be described with reference to the accompanying drawings, which show a non-limiting example thereof, wherein.

PREFERRED EMBODIMENTS OF THE INVENTION

Figure 1:
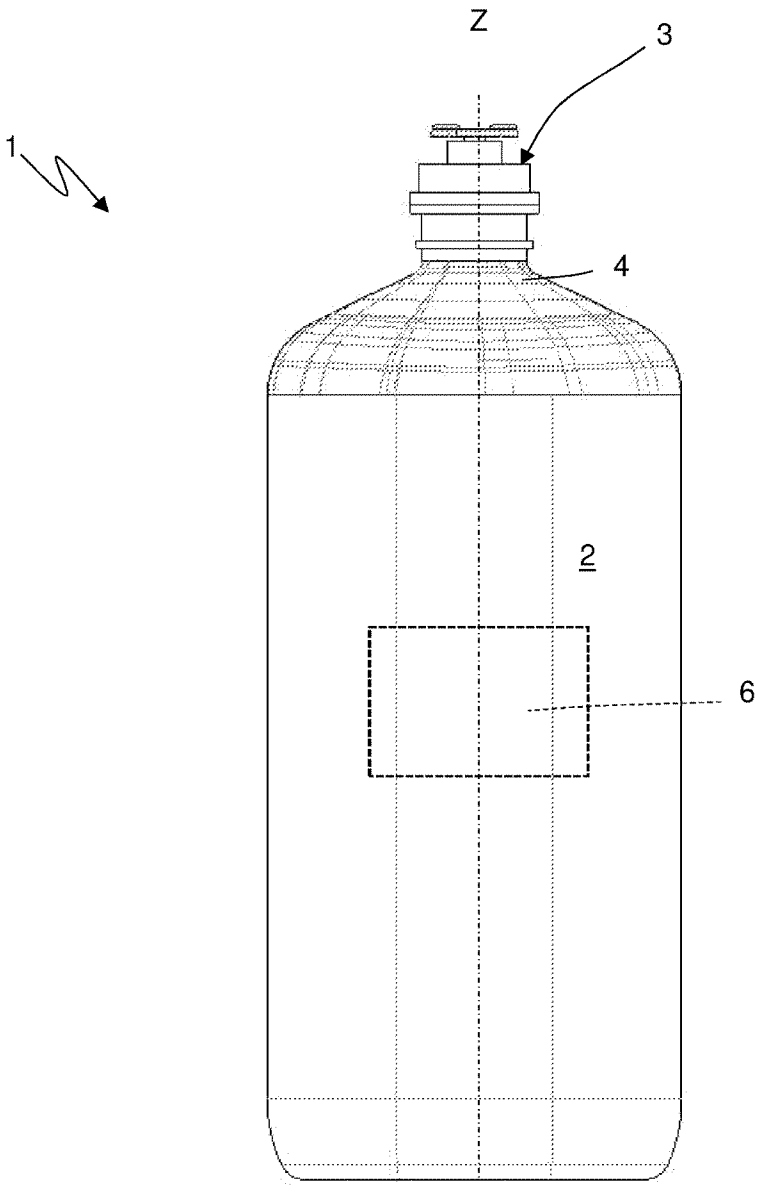
FIG. 1 is a schematic view of a bottle for products of the pharmaceutical industry.
Figure 2:
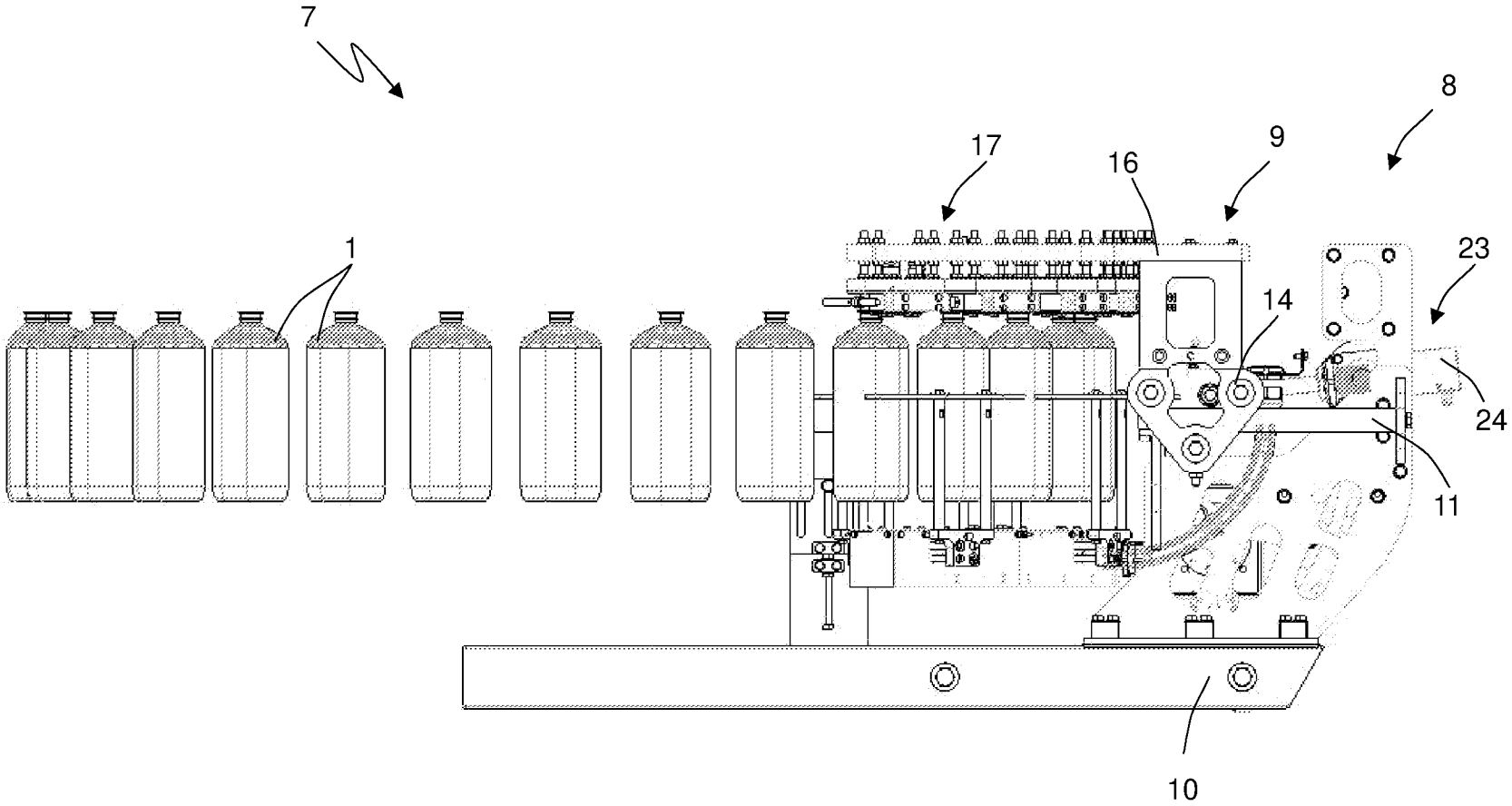
FIG. 2 is a lateral and schematic view of a capping station made according to the present invention, wherein some components have been omitted for clarity.

In FIGS. 1 and 2, the reference numeral 1 indicates a bottle as a whole (bottle, small bottle, flask or other container), for example disposable (i.e. one-use, which is therefore used only once and is then replaced) of a known type particularly suitable for containing a pharmaceutical product 2, in liquid or powdery form. The bottle 1 shown in FIG. 1 is closed by means of a cap 3. The bottle 1 shown in FIG. 1 is also provided with (at least) a label 6 which is glued to an outer surface of the bottle 1.

In particular, the bottle 1 shown in FIG. 1 is generally filled in a filling machine, wherein the bottles 1 are moved along a processing path through a plurality of stations, along which the bottles 1 are, in succession, weighed empty, filled with a predetermined quantity of product 2 of the pharmaceutical industry, weighed full to check that each bottle 1 has been filled correctly (i.e. to check that bottle 1 contains the determined quantity of substance 2 of the pharmaceutical industry), provided with a cap 3, and finally provided with a label 6.

Figure 6:
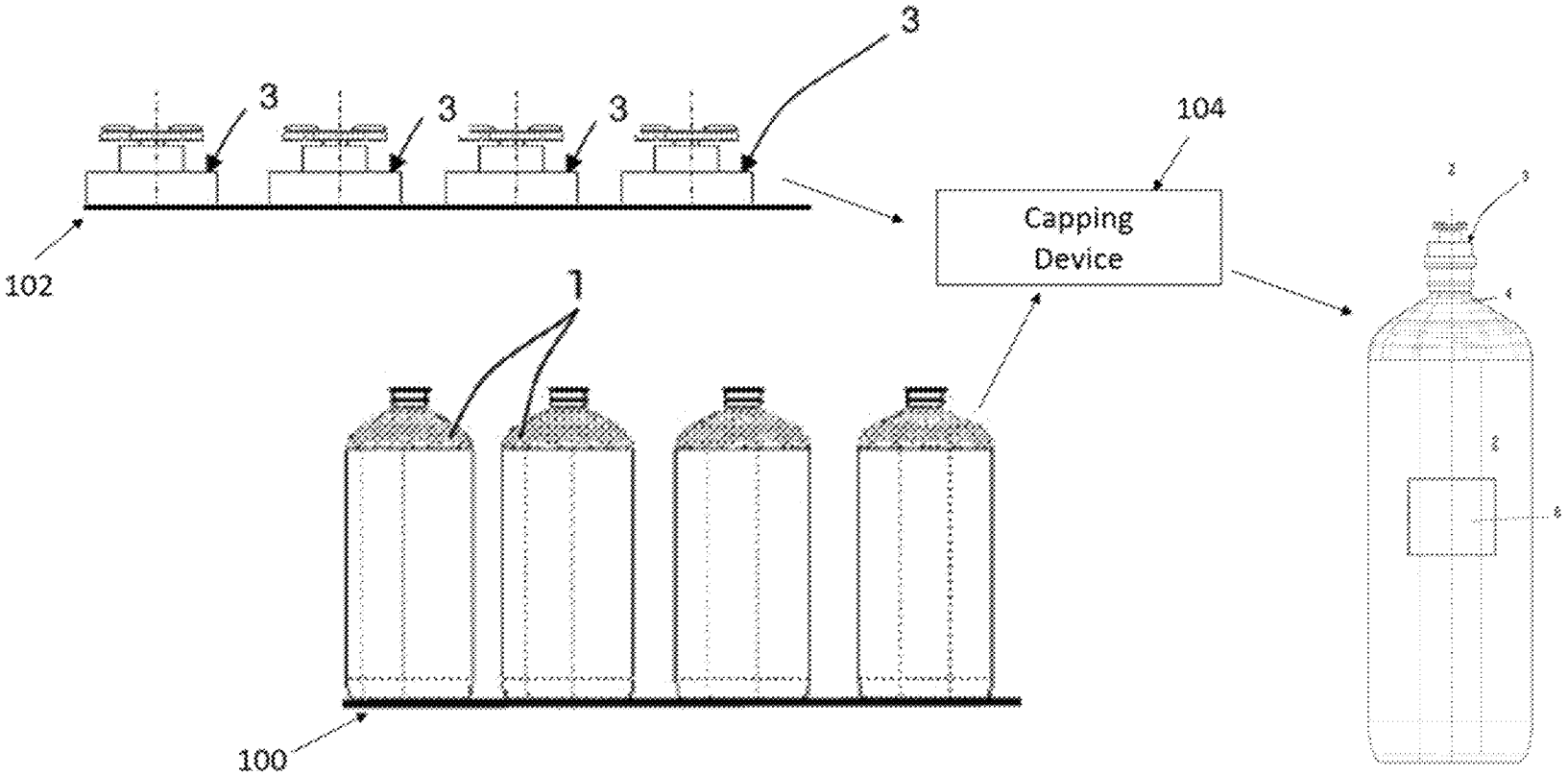
FIG. 6 is a schematic of a capping station in accordance with the disclosure.

The present description is focused on a capping station 7, partly illustrated in FIG. 2, i.e. on that part of the bottle filling machine 1, wherein the full bottles 1 are closed by applying a cap 3. In particular, FIGS. 2 and 6 show a plurality of full bottles 1, preferably made of plastic, which are moved in an upright position along a lower carousel conveyor (100) and which are ready to each receive a closing cap 3. Furthermore, the capping station 7 comprises at least one further upper conveyor (102), typically also of the carousel type, arranged above the lower conveyor and designed for moving a plurality of caps 3 intended to be applied to the neck 4 of each bottle 1 by means of a specially provided capping device (104).

In order to facilitate the application operation of the cap 3, the capping station 7 also comprises a heating unit 8, illustrated in figures from 2 to 5, which is designed for heating at least a neck 4 of each of the bottles 1 to be capped, so as to determine the welding between neck 4 and cap 3 when these are brought into contact with one other.

Hereinafter, reference will be made to a heating unit 8 designed for heating in particular the neck 4 of the bottle 1 before it receives the cap 3; however, such heating unit 8 could also heat the cap 4 to be applied on each bottle 1 to be capped, or alternatively it could heat only the cap 4 to be applied on each bottle 1 to be capped.

Figure 3:
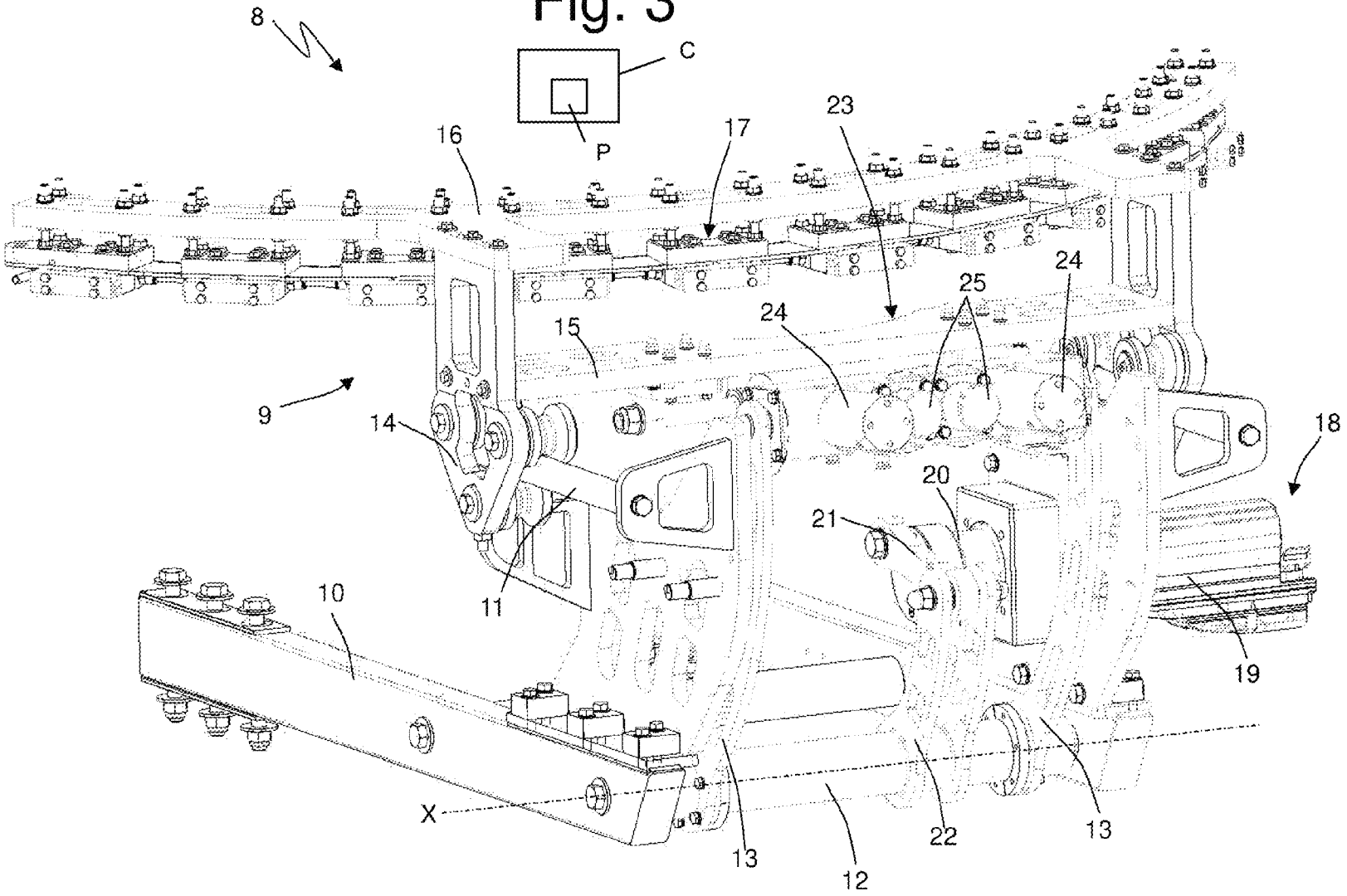
FIG. 3 is a schematic and perspective view of a heating unit of the capping station of FIG. 2.

In detail, the heating unit 8 shown in figures from 2 to 5 comprises a movable frame 9 which is connected to a fixed support body 10 by means of two horizontal guides 11 parallel to one another carried by the fixed support body 10 and by means of a shaft 12 mounted on the fixed support body 10 so as to be rotatable around a horizontal rotation axis X. With particular reference to FIG. 3, the movable frame 9 is connected to the shaft 12 by means of two arms 13, rigidly hinged to the shaft 12 at one end and to the movable frame 9 at the other end; moreover, the frame 9 is sliding along the two guides 11 by means of a pair of opposed carriages 14, which are connected to one other by means of an intermediate bracket 15 and carry a support beam 16 on which a plurality of heating devices 17 are mounted (typically electrical resistances). In this way, the rotation of the shaft 12 will induce a rotation of the arms 13, which will cause the carriages 14 to slide along the guides 11 with consequent movement of the support beam 16 from a rest position (not shown), wherein the heating devices 17 are far from the bottles 1, to a work position, wherein the heating devices 17 are close to the neck 4 of the bottles 1, as shown in FIG. 2, so as to heat the neck 4 of the bottles 1.

With particular reference to FIG. 3, the shaft 12 can be operated in rotation around the rotation axis X by a main operating device 18 which comprises an electric motor 19 provided with an eccentric pin 20 connected to a connecting rod 21, which is in turn hinged to a crank 22 rigidly connected to the shaft 12, so that the activation of the electric motor 19 induces a rotation of the eccentric pin 20 and consequently, thanks to the connecting rod 20-crank 22 mechanism, a rotation of the shaft 12.

Furthermore, the heating unit 8 made according to the invention comprises a safety operating device 23, which is independent of the main operating device 18, and can be operated in emergency conditions, i.e. when a fault of the main operating device 18 occurs (for example of the electric motor 19) to move the support beam 16 from the work position to a rest position, wherein the support beam 16 is at a distance from the bottles 1 such as to ensure that the heat of the heating devices 17 does not excessively heat the bottles 1. Such rest position can coincide with the aforementioned rest position, i.e. that which the support beam 16 assumes following the activation of the main operating device 18, or it can be a different rest position (but in any case more or less close to the rest position assumed due to the activation of the main operating device 18).

The presence of the safety operating device 23 allows eliminating the risk of damage of the bottle 1 or of the cap 3 due to an excessive heating of the bottle 1 or of the cap 3, i.e. to an excessively prolonged heating, ensuring that in the event of a fault of the main operating device 18, the movable frame 9 of the heating unit 8, and therefore the support beam 16, can be promptly removed all the same, advantageously avoiding damaging, or in the worst cases burning, the bottles 1.

In detail, the safety operating device 23 comprises at least one control device C which is arranged for detecting a fault of the main operating device 18 and for operating the safety operating device 23. In particular, the main operating device 18 will be configured for ensuring that at each heating cycle the support beam 16 is operated in movement up to the work position and after a predetermined time interval it is again operated in movement up to a rest position. The control device C will then be programmed for detecting any faults of the main operating device 18 by checking if the support beam 16 remains in the work position for a time longer than the predetermined time interval.

According to an embodiment of the invention, the control device C comprises a position sensor (P) which detects instant by instant the position of the support beam 16, a timer (not shown) which counts the time starting from the moment in which the support beam 16 assumes the work position and resets each time the support beam 16 returns to the rest position, and a processing unit (not shown) which compares instant by instant the time measured by the timer with the predetermined time interval and as soon as the value measured by the timer exceeds the predetermined time value it activates the safety operating device 23, so as to induce, independently of the main operating device 18, the support beam 16 to assume a rest position, inducing in particular the sliding of the carriages 14 along the guides 11 so as to move the support beam 16 away from the bottles 1.

Figure 4:
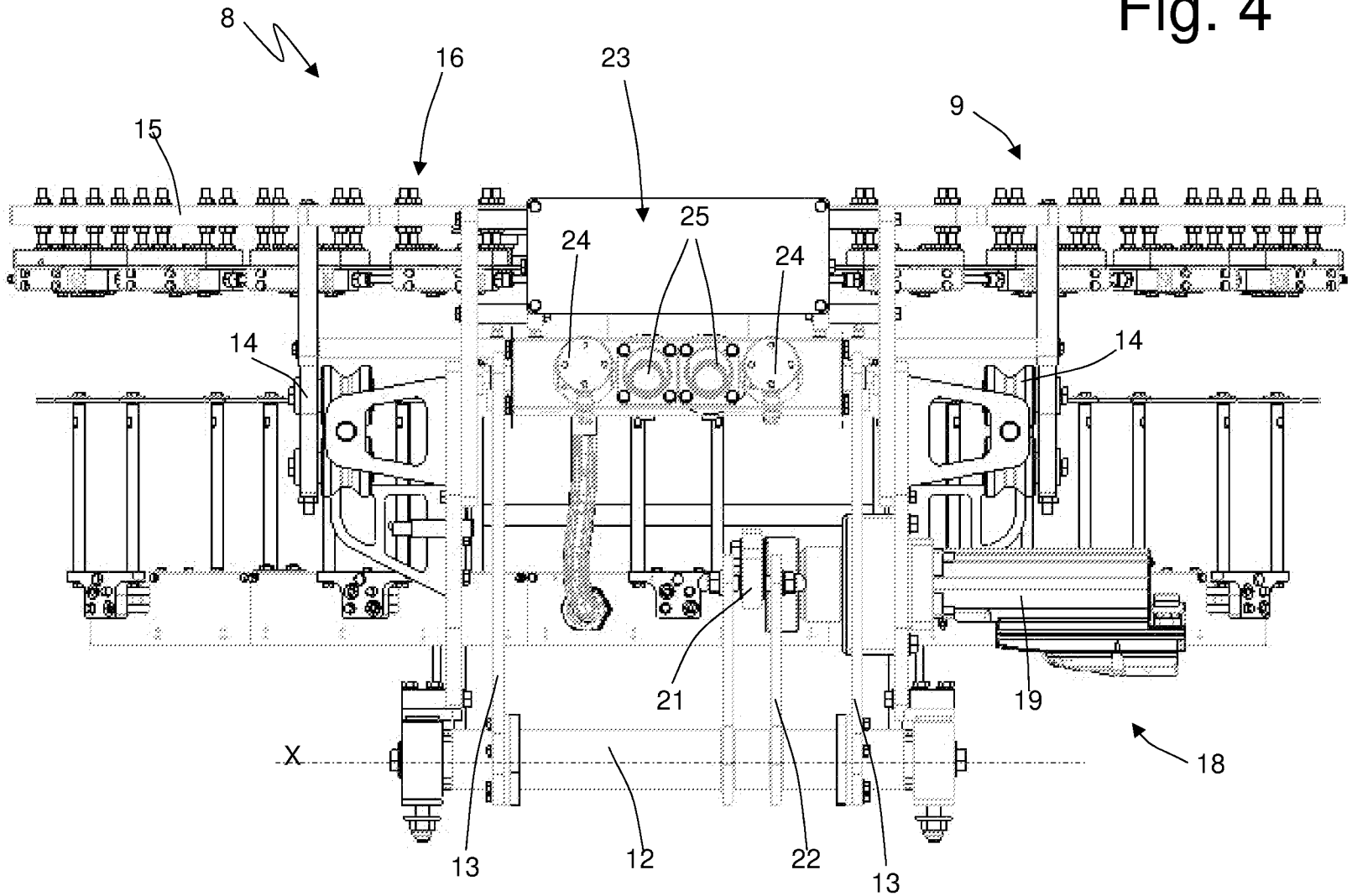
FIG. 4 is a rear view of the heating unit of FIG. 3.
Figure 5:
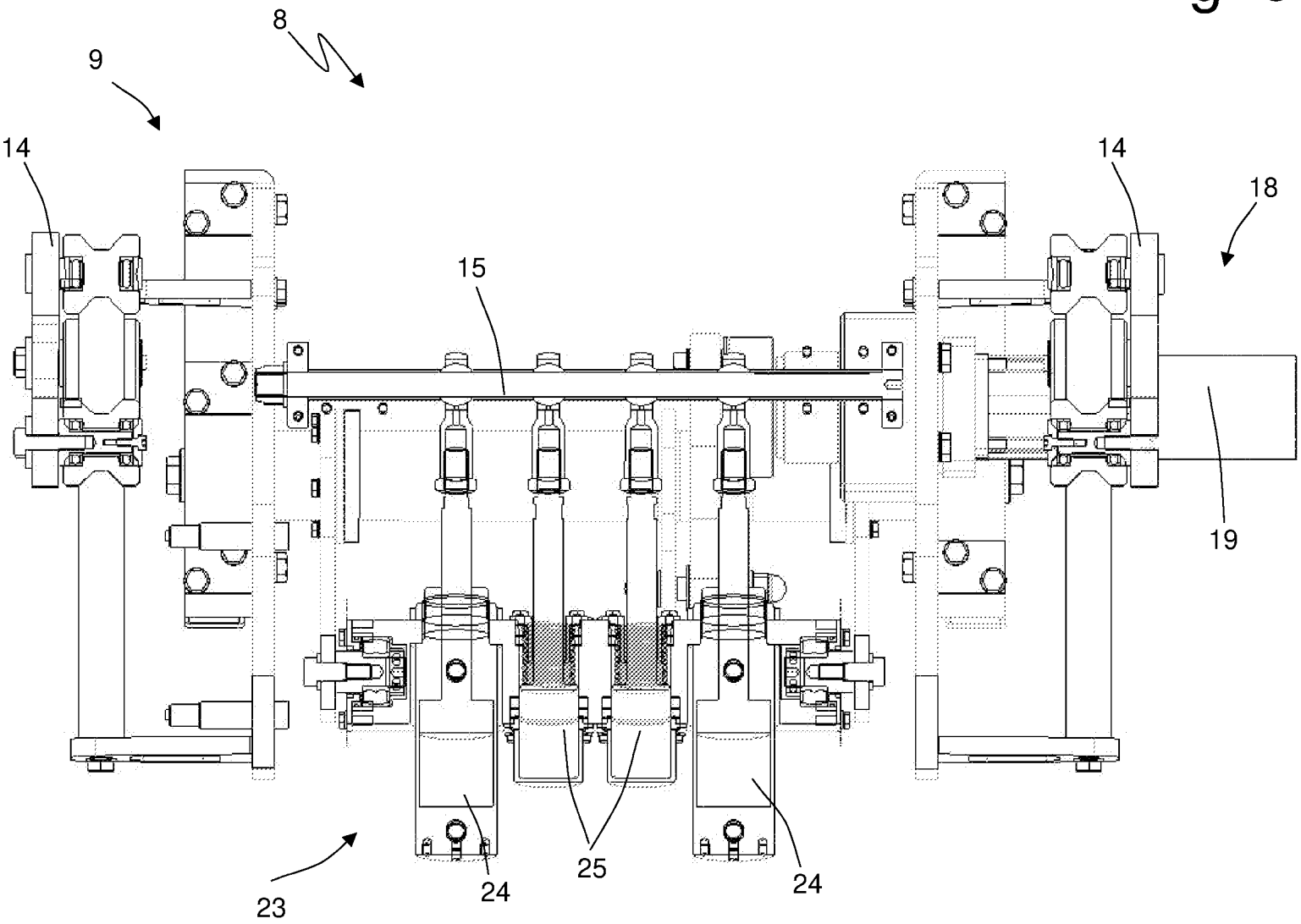
FIG. 5 is plan view of the heating unit of FIG. 3.

With particular reference to FIGS. 3, 4 and 5, the safety operating device 23 is interposed between the main operating device 18 and the carriages 14 for making the carriages 14 slide along the guides 11 independently of the main operating device 18, or independently of the activation of the electric motor 19.

With particular reference to FIGS. 3, 4 and 5, the safety operating device 23 comprises two single-effect pneumatic cylinders 24, normally expanded, arranged for acting on the carriages 14 by means of the intermediate bracket 15 (see FIG. 5), and two elastic elements 25, in particular two normally compressed springs, arranged for acting on the carriages 14 always by means of the intermediate bracket 15, transmitting to the intermediate bracket 15 a direct force away from the bottles 1 which would tend to slide the carriages 14 and therefore the support beam 16 towards the rest position but which is normally opposed by the pneumatic cylinders 24 which are normally expanded. Consequently, when a fault of the main operating device 18 occurs, it will be sufficient to operate the pneumatic cylinders 24 for inducing the return stroke of the pneumatic cylinders 24 so that the contrasting action of the pneumatic cylinders 24 is no longer present; consequently, the elastic elements 25, acting on the intermediate bracket 15, cause the carriages 14 to slide along the guides 11 up to the rest position.

Alternatively, the safety operating device 23 could also comprise a single pneumatic cylinder 24 and/or a single elastic element 25. Each elastic element 25 could also be incorporated in a corresponding pneumatic cylinder 24.

It is understood that the capping station 7 object of the present invention could be used for capping any type of bottle 1 and/or phial and/or flask, for example bottles 1 suitable for cosmetic products, for food products, for cleaning products, etc. Likewise, it is clear that for the purposes of the invention the bottles 1 could be made of glass, instead of plastic, or of a glass-plastic composite material, etc.

It is also understood that the main operating device 18 described above could be made with any other equivalent mechanism, for example the electric motor 19 could be connected directly to the shaft 12, without thereby losing functionality.

The capping station 7 described above has numerous advantages.

First, the capping station 7 allows heating efficiently at least the neck 4 of the bottle 1 so as to facilitate the application of the cap 3 in conditions of maximum safety, minimizing the risk of damage of the bottle 1 and/or of the cap 3. In this way, it will be possible to reduce the percentage of waste (i.e. defective bottles 1) without compromising the speed of the capping station 7 and therefore the hourly productivity.

Finally, the capping station 7 described above is simple and cost-effective to manufacture, as it is composed of few additional elements with respect to the known capping stations and said additional elements are structurally simple, just as the movements of the operating devices are simple and easy to implement.

The invention claimed is:

1. A capping station (7) for a filling machine to fill bottles (1); the capping station (7) comprising:

a first conveying system, which is designed to move a plurality of full bottles (1) in an upright position;

a second conveying system, which is arranged above the first conveying system and is designed to move a plurality of caps (3), each designed to close a respective bottle (1);

a capping device, which is designed to pick up at least one cap (3) from the second conveying system in order to apply the cap (3) to a bottle (1) carried by the first conveying system;

a heating unit (8) comprising at least one heating device (17), a support beam (16), which carries the heating device (17), and a main operating device (18), which is designed to move the support beam (16) between a rest position, in which the heating device (17) is far from a corresponding bottle (1), and a work position, in which the heating device (17) is close to a corresponding bottle (1) so that the heat of the heating device (17) heats at least a neck (4) of the bottle (1); and a control device, wherein:

the heating unit (8) comprises a safety operating device (23), which is independent of the main operating device (18) and is designed to move the support beam (16) between the work position and a rest position, in which the heating device (17) is far from a corresponding bottle (1), and the control device is designed to detect a fault of the main operating device (18) and to operate the safety operating device (23) in case of a fault of the main operating device (18).

2. The capping station (7) according to claim 1, wherein the control device is provided with at least one position sensor, which is designed to detect the position of the support beam (16) and detects a fault of the main operating device (18) depending on a reading of the position sensor.

3. The capping station (7) according to claim 1, and comprising:

at least one guide (11); and at least one carriage (14), which carries the support beam (16) and is coupled to the guide (11) in a sliding manner so as to move the support beam between the work position and the rest position.

4. The capping station (7) according to claim 3, wherein both the main operating device (18) and the safety operating device (23) are designed to cause the carriage (14) to slide along the guide (11).

5. The capping station (7) according to claim 4, wherein the main operating device (18) comprises:

a shaft (12), which is mounted so as to rotate around a rotation axis (X);

at least one arm (13), which at an end is rigidly mounted on the shaft (12) and at the opposite end is hinged to the safety operating device (23); and a rotary electric motor (19), which rotates the shaft (12) around the rotation axis (X).

6. The capping station (7) according to claim 5, wherein the main operating device (18) comprises:

an eccentric pin (20), which is caused to rotate by the rotary electric motor (19); and a connecting rod-crank mechanism, which transmits the motion from the eccentric pin (20) to the shaft (12).

7. The capping station (7) according to claim 6, wherein the connecting rod-crank mechanism comprises:

a connecting rod (21), which at an end is hinged to the eccentric pin (20); and a crank (22), which at an end is hinged to the connecting rod (21) and at the opposite end is rigidly connected to the shaft (12).

8. The capping station (7) according to claim 4, wherein the safety operating device (23) is interposed between the main operating device (18) and the carriage (14) in order to transmit the movement caused by the main operating device (18) to the carriage (14).

9. The capping station (7) according to claim 8 and comprising:

two guides (11), which are parallel to one another;

two carriages (14), which are each coupled to a corresponding guide (11); and an intermediate bracket (15), which joins the two carriages (14) to one another and is connected to the safety operating device (18).

10. The capping station (7) according to claim 8, wherein the safety operating device (23) comprises at least one pneumatic cylinder (24), which normally is expanded, at an end is connected to the carriage (14) and at the opposite end is connected to the main operating device (18).

11. The capping station (7) according to claim 10, wherein the pneumatic cylinder (24) is a single-acting cylinder and there is an elastic element (25), which is arranged in parallel to the pneumatic cylinder (24) and is countered by the pneumatic cylinder (24).

12. The capping station (7) according to claim 11, wherein the elastic element (25) pushes the carriage (14) towards the rest position.

* * * * *